US007327851B2

(12) United States Patent
Song

(10) Patent No.: US 7,327,851 B2
(45) Date of Patent: Feb. 5, 2008

(54) PARALLELEPIPED CONDENSER MICROPHONE

(75) Inventor: Chung Dam Song, Seoul (KR)

(73) Assignee: BSE Co., Ltd., Incheon (KR)

( * ) Notice: Subject to any disclaimer, the term of this patent is extended or adjusted under 35 U.S.C. 154(b) by 515 days.

(21) Appl. No.: 11/064,606

(22) Filed: Feb. 24, 2005

(65) Prior Publication Data

US 2005/0185811 A1 Aug. 25, 2005

(30) Foreign Application Priority Data

Feb. 24, 2004 (KR) ..... 10-2004-0012309

(51) Int. Cl.
*H04R 25/00* (2006.01)

(52) U.S. Cl. ..... 381/174; 381/369; 381/191

(58) Field of Classification Search ..... 381/113, 381/181, 173–176, 191, 355, 369; 367/170, 367/181; 29/25.41, 25.42, 594
See application file for complete search history.

(56) References Cited

U.S. PATENT DOCUMENTS 7,184,563 B2 * 2/2007 Collins ..... 381/191
7,233,674 B2 * 6/2007 Song ..... 381/174
7,260,230 B2 * 8/2007 Feng ..... 381/174
7,269,267 B2 * 9/2007 Song et al. ..... 381/174

* cited by examiner

*Primary Examiner*—Huyen Le
(74) *Attorney, Agent, or Firm*—Keusey, Tutunjian & Bitetto, P.C.

(57) ABSTRACT

There is provided a surface mount parallelepiped condenser microphone. In the surface mount parallelepiped condenser microphone, a case has a rectangular box shape with an opening, a backplate has a circular shape with a sound hole, a spacer has thin ring shape, an insulation ring has a hollow cylindrical shape with top and bottom openings, a diaphragm faces the backplate with disposing the spacer therebetween, and a PCB has a rectangular shape with a sound hole at a center portion, the PCB being electrically connected with the diaphragm through a conductive ring, wherein a metal ring, the backplate, the spacer, the insulation ring, the diaphragm, the conductive ring, and the PCB are sequentially disposed in the case, and the case is curled at the opening. Therefore, the direction of the surface mount condenser microphone can be easily detected when mounting on a main PCB.

21 Claims, 9 Drawing Sheets

PARALLELEPIPED CONDENSER MICROPHONE

BACKGROUND OF THE INVENTION

1. Field of the Invention

The present invention relates to a condenser microphone, and more particularly, to a parallelepiped condenser microphone in which a sound hole is defined in a printed circuit board (PCB).

2. Description of the Related Art

Typical condenser microphones include a voltage bias component (electret), a pair of diaphragm and backplate, and a junction field effect transistor (JFET). The pair of diaphragm and backplate forms a capacitor of which capacitance varies in response to sound pressure. The JFET is used to buffer an output signal.

FIG. 1 is a perspective view of a condenser microphone according to the related art.

Referring to FIG. 1, a condenser microphone 10 includes a cylindrical case forming the exterior of the condenser microphone. In the cylindrical case, a diaphragm having a polar ring and a membrane, a spacer, a backplate, a non-conductive and ring-shaped first base, a conductive second base, and a PCB with two connecting terminals are included.

When mounting the condenser microphone on a main PCB by using a surface mount technology (SMT), the connecting terminals of the PCB of the condenser microphone should be exactly connected with terminals of the main PCB. However, the condenser microphone is not suitable for using the SMT because leading ends of the connecting terminals are lower than a curled surface of the case. This structure may cause soldering failure. Specifically, since it is difficult to check the positions of the terminals when a plurality of terminals are to be connected to one another, polarity mismatches and poor contacts such as abnormally aligned contacts may be caused.

SUMMARY OF THE INVENTION

Accordingly, the present invention is directed to a surface mount parallelepiped condenser microphone that substantially obviates one or more problems due to limitations and disadvantages of the related art.

An object of the present invention is to provide a surface mount condenser microphone that has a sound hole in its PCB and a parallelepiped shape for easy direction finding during the surface mounting process.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a surface mount parallelepiped condenser microphone, including: a case having a rectangular box shape with an opening; a metal ring insertable into the case; a backplate having a circular shape with a sound hole; a spacer having a thin ring shape; an insulation ring having a hollow cylindrical shape with top and bottom openings; a diaphragm facing the backplate with disposing the spacer therebetween when inserted in the insulation ring; a conductive ring for electrically connecting the diaphragm to a printed circuit board (PCB); and a printed circuit board (PCB) having a rectangular shape with a sound hole at a center portion, the PCB having one side on which a component is mounted and the other side on which a terminal is protruded, wherein the metal ring, the backplate, the spacer, the insulation ring, the diaphragm, the conductive ring, and the PCB are sequentially disposed in the case, and the case is curled at the opening.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF PREFERRED EMBODIMENTS

Reference will now be made in detail to the preferred embodiments of the present invention, examples of which are illustrated in the accompanying drawings.

Figure 1:
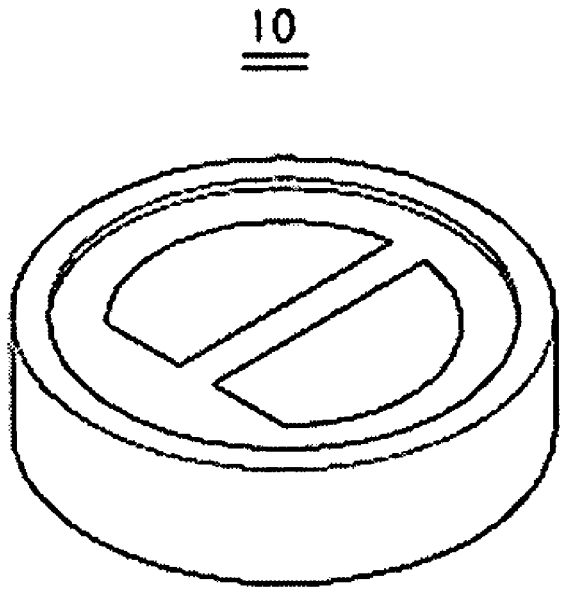
FIG.1 (PRIOR ART)
FIG. 1 is a perspective view of a condenser microphone according to the related art.
Figure 2:
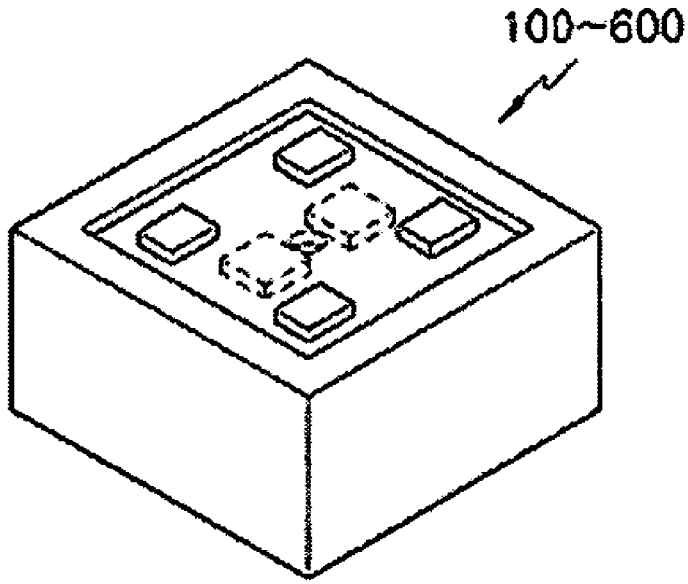
FIG. 2 is a perspective view of a parallelepiped condenser microphone according to the present invention.

FIG. 2 is a perspective view of a parallelepiped condenser microphone according to the present invention.

Referring to FIG. 2, a condenser microphone (100-600), of which components are disposed in a parallelepiped case, is to be mounted on a main PCB by connecting terminals of its PCB to the main PCB. The condenser microphone is designed to have a parallelepiped shape to easily align the condenser microphone with the main PCB, such that when mounting the condenser microphone on the main PCB their terminals can be connected without polarity mismatch and abnormal alignment. Further, the condenser microphone defines a sound hole in its PCB instead of its case, such that the sound hole can be easily aligned with a sound hole of the main PCB when mounting the condenser microphone on the main PCB. The condenser microphone of the present invention may be constructed with various components. The condenser microphone will be described more fully with reference to the following six exemplary embodiments.

First Embodiment

Figure 3:
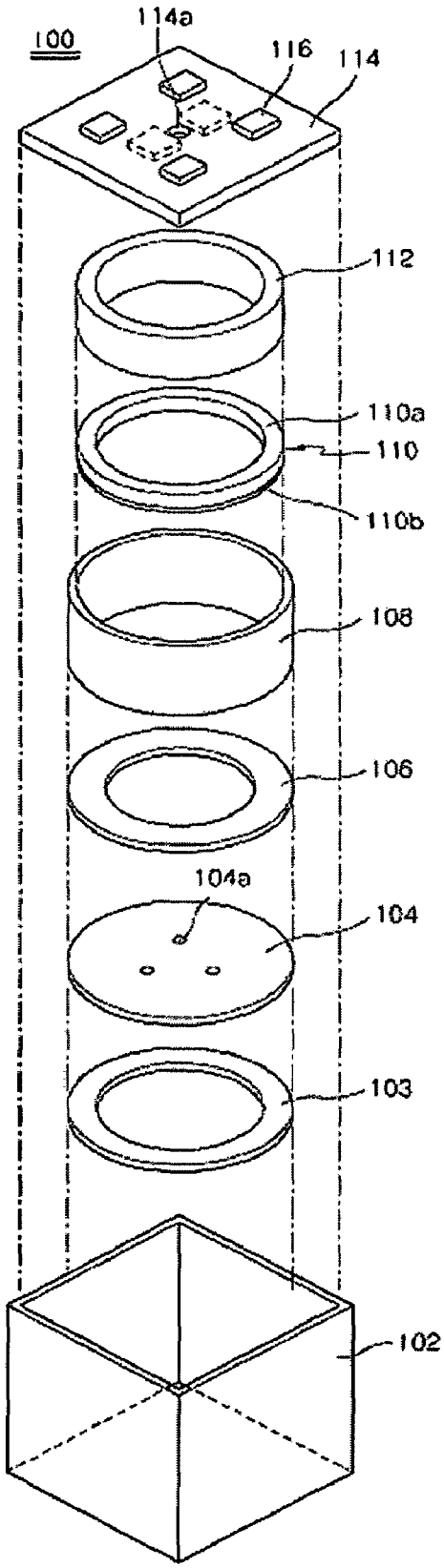
FIG. 3 is an exploded perspective view of a parallelepiped condenser microphone according to a first embodiment of the present invention.

FIG. 3 is an exploded perspective view of a parallelepiped condenser microphone according to a first embodiment of the present invention.

Referring to FIG. 3, a condenser microphone 100 includes a rectangular box-shaped case 102, a metal ring 103, a circular backplate 104, a thin and ring-shaped spacer 106, an insulation ring 108, a diaphragm 110, a conductive ring 112, and a rectangular PCB 114.

The case 102 has a closed bottom and an opened top. The metal ring 103 is to be inserted in the case 102 to electrically connect the case 102 and the backplate 104. The backplate 104 includes a metal plate, an organic film layer (electret layer) coated on the metal plate, and sound holes 104*a*. The insulation ring 108 has a hollow cylindrical shape with opened top and bottom. The diaphragm 110 includes a polar ring 110*a* for an electrical connection with the conductive ring 112 and a membrane 110*b* capable of vibrating in response to sound pressure. The conductive ring 112 electrically connects the diaphragm 110 to the PCB 114 (when assembled). The PCB 114 has one side on which elements (e.g., IC and MLCC) are mounted and the other side from which terminals 116 are protruded. The PCB 114 also defines a sound hole 114*a*.

Second Embodiment

Figure 4:
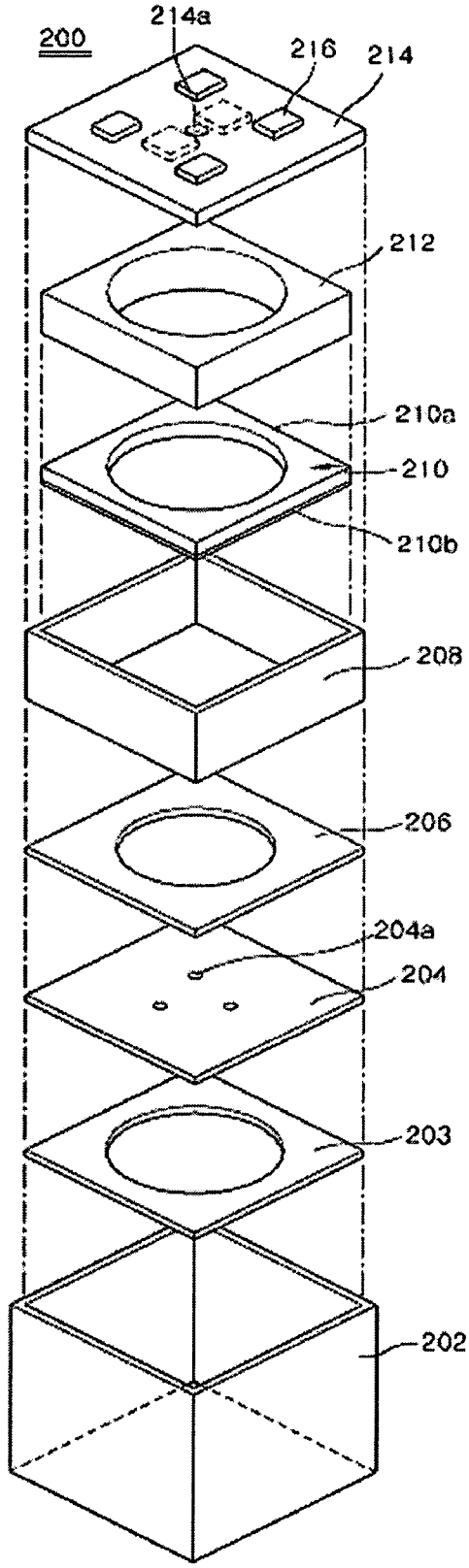
FIG. 4 is an exploded perspective view of a parallelepiped condenser microphone according to a second embodiment of the present invention.

FIG. 4 is an exploded perspective view of a parallelepiped condenser microphone according to a second embodiment of the present invention.

Referring to FIG. 4, a condenser microphone 200 includes a rectangular box-shaped case 202, a rectangular metal ring 203, a rectangular backplate 204, a rectangular spacer 206, a rectangular insulation ring 208, a rectangular diaphragm 210, a rectangular conductive ring 212, and a rectangular PCB 214.

The case 202 has a closed bottom and an opened top. The rectangular metal ring 203 defines a circular opening at its center portion and is to be inserted in the case 202. The backplate 204 includes a metal plate, an organic film layer (electret layer) coated on the metal plate, and sound holes 204*a*. The rectangular spacer 206 defines a circular opening at its center portion. The insulation ring 208 has a hollow rectangular prism shape with opened top and bottom. The diaphragm 210 includes a polar ring 210*a* for an electrical connection with the conductive ring 212 and a membrane 210*b* capable of vibrating in response to sound pressure. The polar ring 210*a* has a rectangular shape with a circular opening at its center portion. The diaphragm 210 is to be disposed in the insulation ring 208 to face with the backplate 204 with interposing the space 206 therebetween. The rectangular conductive ring 212 defines a circular opening at its center portion, and electrically connects the diaphragm 210 to the PCB 214 when assembled. The PCB 214 has one side on which elements (e.g., IC and MLCC) are mounted and the other side from which terminals 216 are protruded. The PCB 214 also defines a sound hole 214*a*.

Third Embodiment

Figure 5:
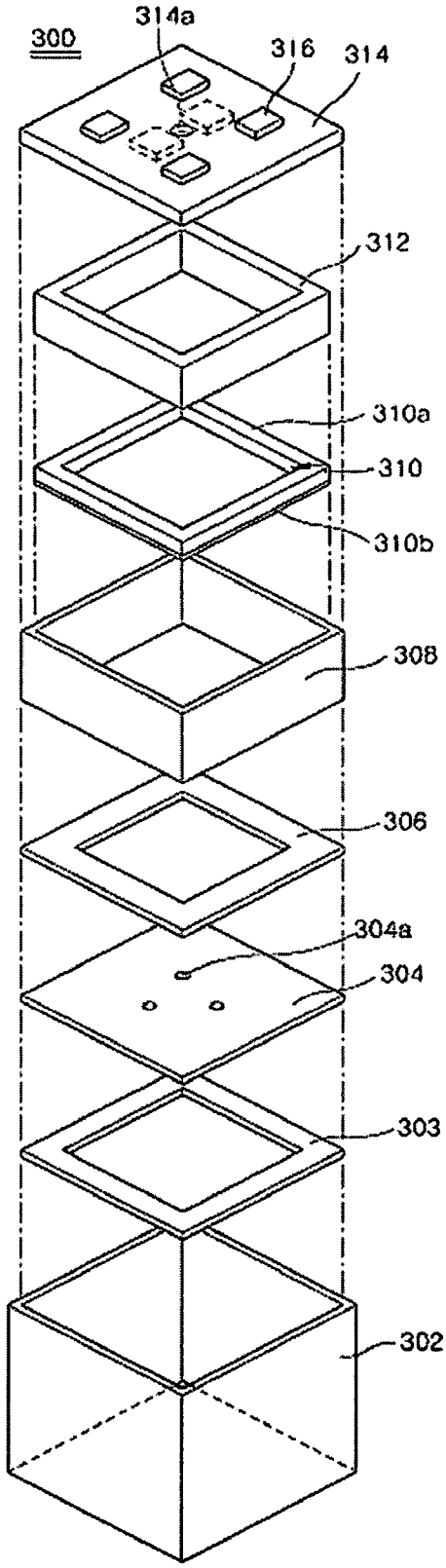
FIG. 5 is an exploded perspective view of a parallelepiped condenser microphone according to a third embodiment of the present invention.

FIG. 5 is an exploded perspective view of a parallelepiped condenser microphone according to a third embodiment of the present invention.

Referring to FIG. 5, a condenser microphone 300 includes a rectangular box-shaped case 302, a rectangular metal ring 303, a rectangular backplate 304, a rectangular spacer 306, a rectangular insulation ring 308, a rectangular diaphragm 310, a rectangular conductive ring 312, and a rectangular PCB 314.

The case 302 has a closed bottom and an opened top. The rectangular metal ring 303 is to be inserted in the case 302 and defines a rectangular opening at its center portion. The backplate 304 includes a metal plate, an organic film layer (electret layer) coated on the metal plate, and sound holes 304*a*. The rectangular spacer 306 defines a rectangular opening at its center portion. The insulation ring 308 has a hollow rectangular prism shape with opened top and bottom. The diaphragm 310 is capable of being inserted in the rectangular insulation ring 308, and includes a rectangular polar ring 310*a* for an electrical connection with the conductive ring 312 and a membrane 310*b* capable of vibrating in response to sound pressure. The rectangular conductive ring 312 defines a rectangular opening at its center portion, and electrically connects the diaphragm 310 to the PCB 314 when assembled. The PCB 314 has one side on which elements (e.g., IC and MLCC) are mounted and the other side on which terminals 316 are formed. The PCB 314 also defines a sound hole 314*a*.

Assembly of the First to Third Embodiments

Figure 6:
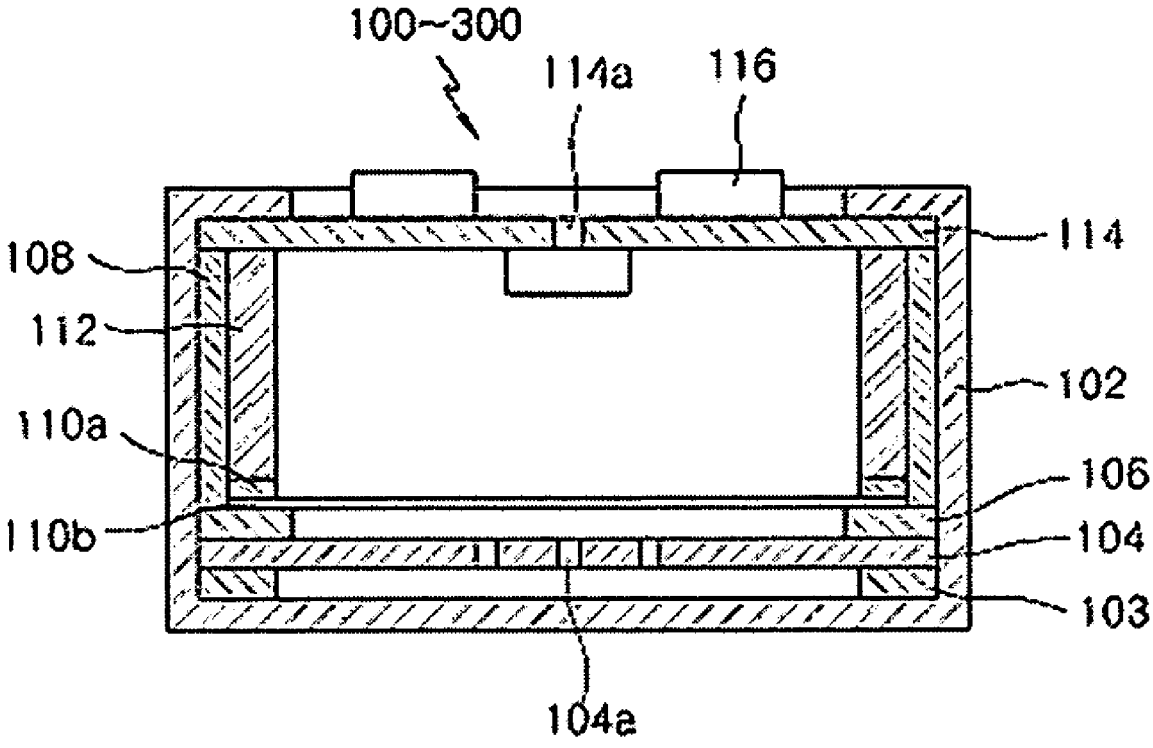
FIG. 6 is a sectional view of an assembled parallelepiped condenser microphone according to the first to third embodiments of the present invention.

FIG. 6 is a sectional view of an assembled parallelepiped condenser microphone according to the first to third embodiments of the present invention, in which reference numerals of the first embodiment are only presented for clarity.

Referring to FIG. 6, a condenser microphone (100-300) includes a metal ring 103, a backplate 104, a spacer 106, an insulation ring 108, a polar ring 110*a*, a membrane 110*b*, a conductive ring 112, and a PCB 114 with a sound hole 114*a*, which are sequentially disposed in a rectangular case 102. After the disposing, top of the case 102 is curled.

Terminals 116 of the PCB 114 are protruded from the curled surface of the case 102, such that a surface mounting process can be easily carried out to mount the condenser microphone (100-300) on a main PCB such as a main PCB of a cellular phone. The terminals 116 may be a Vdd terminal, a ground terminal and so on.

In the first to third embodiments, corners or edges of rectangular elements of the condenser microphone can be rounded for manufacturing or assembling convenience. An integrated circuit (IC) of the PCB may be a junction field effect transistor (JFET), an amplifier, or an analog-to-digital converter. Also, the IC of the PCB may be an application-specific integrated circuit (ASIC) with a JFET, an amplifier, and an analog-to-digital converter.

The operation of the condenser microphone of the first to third embodiments will now be described.

Vdd and GND powers are applied to the terminals 116 through terminals of a main PCB. Therefore, The membrane 110*b* is electrically connected with the PCB 114 through the conductive ring 112 and polar ring 110*a*, and the backplate 104 is electrically connected with the PCB 114 through the case 102.

Outside sound enters inside of the condenser microphone through the sound hole 114*a* of the PCB 114 and then reaches the membrane 110*b*.

The membrane 110*b* vibrates in response to the sound pressure, changing the distance between the membrane 110*b* and the backplate 104. This distance change causes variation of capacitance of the membrane 110*b* and the backplate 104, such that electrical signal proportional to the sound pressure can be produced. The electrical signal is transmitted to the IC of the PCB where the signal is amplified and outputted through the terminals 116.

Fourth Embodiment

Figure 7:
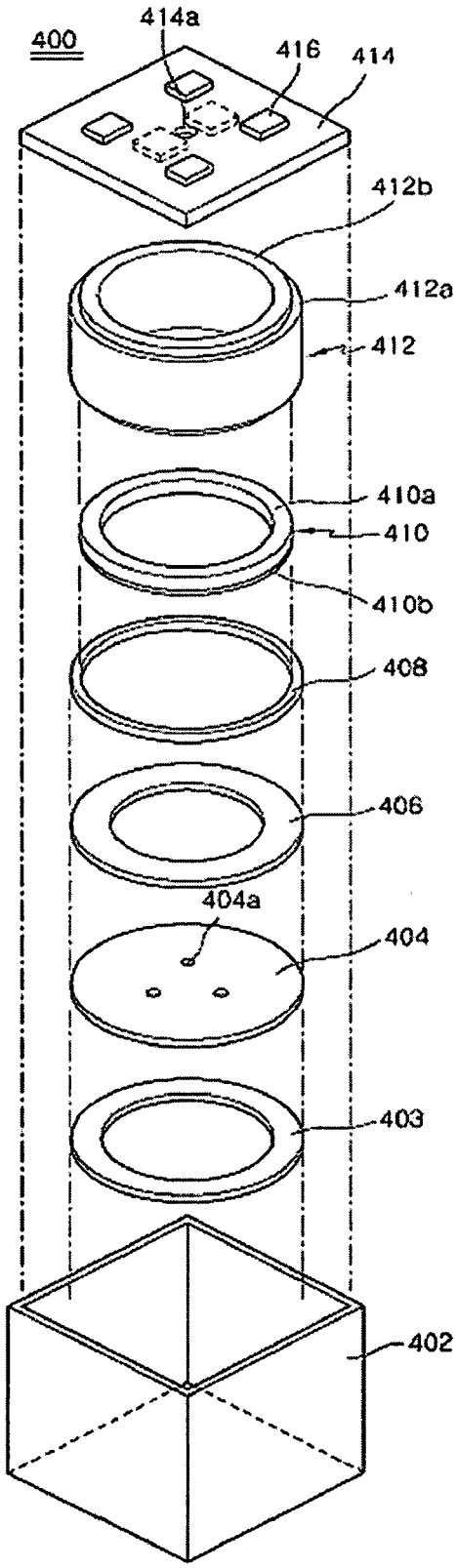
FIG. 7 is an exploded perspective view of a parallelepiped condenser microphone according to a fourth embodiment of the present invention.

FIG. 7 is an exploded perspective view of a parallelepiped condenser microphone according to a fourth embodiment of the present invention.

Referring to FIG. 7, a condenser microphone 400 includes a rectangular box-shaped case 402, a metal ring 403, a circular backplate 404, a thin and ring-shaped spacer 406, a shield ring 408, a diaphragm 410, an integrated base ring 412, and a rectangular PCB 414.

The case 402 has a closed bottom and an opened top. The metal ring 403 is insertable into the case 402. The backplate 404 includes a metal plate, an organic film layer (electret layer) coated on the metal plate, and sound holes 404*a*. The shield ring 408 is provided for insulating the diaphragm 410 to be inserted therein. The integrated base ring 412 includes a hollow cylindrical nonconductive ring 412*a* with opened top and bottom, and a conductive layer 412*b* of metal plate formed on both ends and inside surface of the nonconductive ring 412*a* for electrically connecting the diaphragm 410 to the PCB 414. The diaphragm 410 includes a polar ring 410*a* for an electrical connection with the conductive layer 412*b* and a membrane 410*b* capable of vibrating in response to sound pressure. The PCB 414 has one side on which elements (e.g., IC and MLCC) are mounted and the other side on which terminals 416 are formed. The PCB 414 also defines a sound hole 414*a*.

The outer diameter of the conductive layer 412*b* is smaller that that of the nonconductive ring 412*a* (distinctly seen in FIG. 10) to prevent an electrical connection with the case 402. The integrated base ring 412 may be formed using a PCB fabrication technology. The integrated base ring 412 combines the functions of the related art bases, nonconductive base and conductive base. The nonconductive ring 412*a* may be a substrate made of glass epoxy, resin, PVC or the like.

Further, the conductive layer 412*b* may be formed on the top and bottom ends of the nonconductive ring 412*a* except on the inside surface of the nonconductive ring 412*a*, and a through or via hole which may be formed in the nonconductive ring 412*a* to electrically connect them.

Fifth Embodiment

Figure 8:
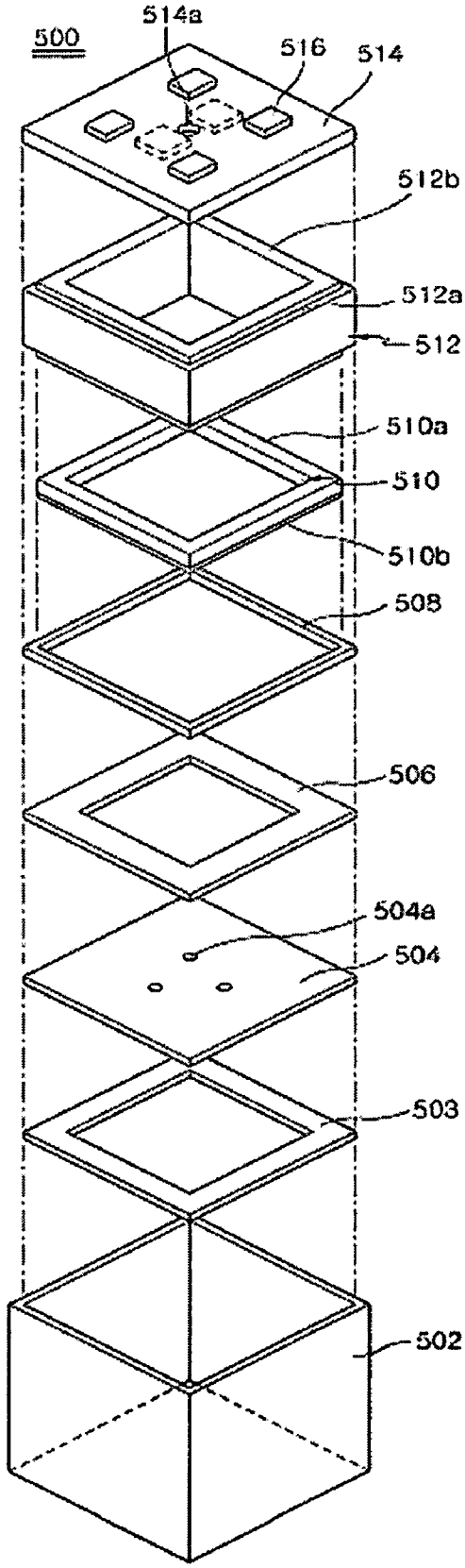
FIG. 8 is an exploded perspective view of a parallelepiped condenser microphone according to a fifth embodiment of the present invention.

FIG. 8 is an exploded perspective view of a parallelepiped condenser microphone according to a fifth embodiment of the present invention.

Referring to FIG. 8, a condenser microphone 500 includes a rectangular box-shaped case 502, a rectangular metal ring 503, a rectangular backplate 504, a rectangular spacer 506, a rectangular shield ring 508, a rectangular diaphragm 510, a rectangular integrated base ring 512, and a rectangular PCB 514.

The case 502 has a closed bottom and an opened top. The rectangular metal ring 503 is to be inserted in the case 502 and defines a rectangular opening at a center portion. The backplate 504 includes a metal plate, an organic film layer (electret layer) coated on the metal plate, and sound holes 504*a*. The rectangular spacer 506 defines a rectangular opening at a center portion. The shield ring 508 is provided for insulating the diaphragm 510 to be inserted therein. The integrated base ring 512 includes a hollow rectangular prism shaped nonconductive ring 512*a* with opened top and bottom, and a metal-plated conductive layer 512*b* formed on both ends and inside the surface of the nonconductive ring 512*a* for connecting the diaphragm 510 electrically to the PCB 514. The diaphragm 510 includes a rectangular polar ring 510*a* for an electrical connection with the conductive layer 512*b* and a membrane 510*b* capable of vibrating in response to sound pressure. The PCB 514 has one side on which elements (e.g., IC and MLCC) are mounted and the other side on which terminals 516 are formed. The PCB 514 also defines a sound hole 514*a* therein.

The outer diameter of the conductive layer 512*b* is smaller that that of the nonconductive ring 512*a* (distinctly seen in FIG. 10) to prevent an electrical connection with the case 502. The integrated base ring 512 may be formed using a PCB fabrication technology. The integrated base ring 512 combines the functions of the related art bases, nonconductive base and conductive base. The nonconductive ring 512*a* may be a substrate made of glass epoxy, resin, PVC or the like.

Further, the conductive layer 512*b* may be formed on the top and bottom ends of the nonconductive ring 512*a* except on the inside surface of the nonconductive ring 512*a*, and a through or via hole may be formed in the nonconductive ring 512*a* to electrically connect them.

Sixth Embodiment

Figure 9:
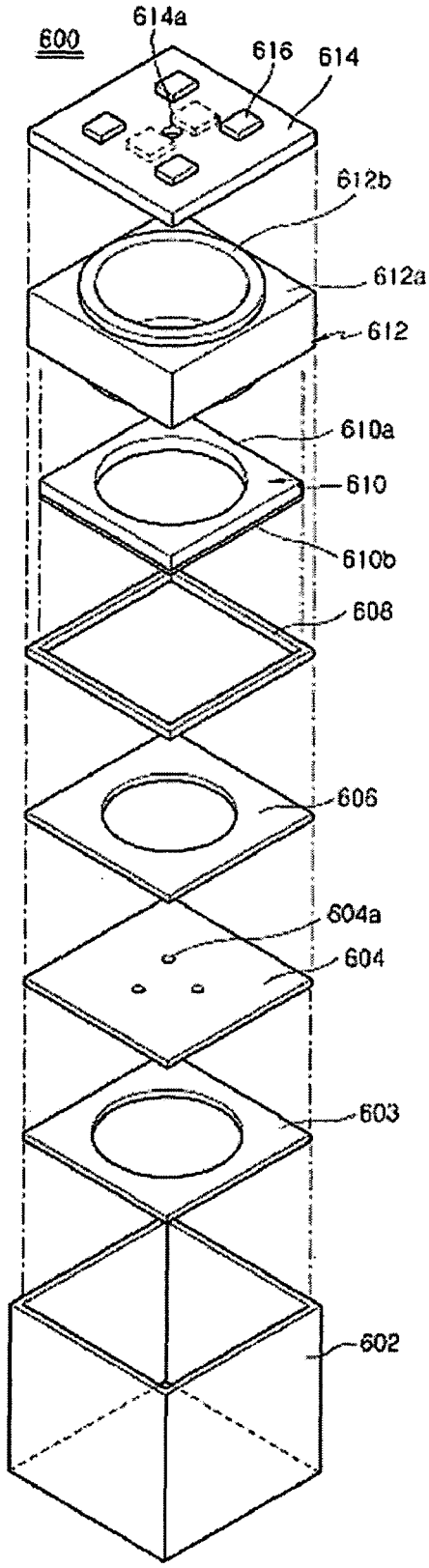
FIG. 9 is an exploded perspective view of a parallelepiped condenser microphone according to a sixth embodiment of the present invention.

FIG. 9 is an exploded perspective view of a parallelepiped condenser microphone according to a sixth embodiment of the present invention.

Referring to FIG. 9, a condenser microphone 600 includes a rectangular box-shaped case 602, a rectangular metal ring 603, a rectangular backplate 604, a rectangular spacer 606, a rectangular shield ring 608, a rectangular diaphragm 610, a rectangular integrated base ring 612, and a rectangular PCB 614.

The case 602 has a closed bottom and an opened top. The rectangular metal ring 603 is to be inserted in the case 602 and defines a circular opening at a center portion. The backplate 604 includes a metal plate, an organic film layer (electret layer) coated on the metal plate, and sound holes 604*a*. The rectangular spacer 606 defines a circular opening in a center portion. The rectangular shield ring 608 defines a rectangular opening at a center portion for insulating the diaphragm 610 when the diaphragm 610 is inserted therein. The integrated base ring 612 includes a rectangular prism shaped nonconductive ring 612*a* with a circular opening therethrough, and a metal-plated conductive layer 612*b* formed on top and bottom ends and on the inside surface of the nonconductive ring 612*a* for electrically connecting the diaphragm 610 to the PCB 614. The diaphragm 610 includes a rectangular polar ring 610*a* with a circular opening for an electrical connection with the conductive layer 612*b*. The diaphragm 610 also includes a membrane 610*b* capable of vibrating in response to sound pressure. The PCB 614 has one side on which elements (e.g., IC and MLCC) are mounted and the other side on which terminals 616 are formed. The PCB 614 also defines a sound hole 614*a*.

The outer diameter of the conductive layer 612*b* is smaller that that of the nonconductive ring 612*a* (distinctly seen in FIG. 10) to prevent an electrical connection with the case 602. The integrated base ring 612 may be formed using a PCB fabrication technology. The integrated base ring 612 combines the functions of the related art bases, nonconductive base and conductive base. The nonconductive ring 612*a* may be a substrate made of glass epoxy, resin, PVC or the like.

Further, the conductive layer 612*b* may be formed on the top and bottom ends of the nonconductive ring 612*a* except on the inside surface of the nonconductive ring 612*a*, and a through or via hole may be formed in the nonconductive ring 612*a* to electrically connect them.

Assembly of the Fourth to Sixth Embodiments

Figure 10:
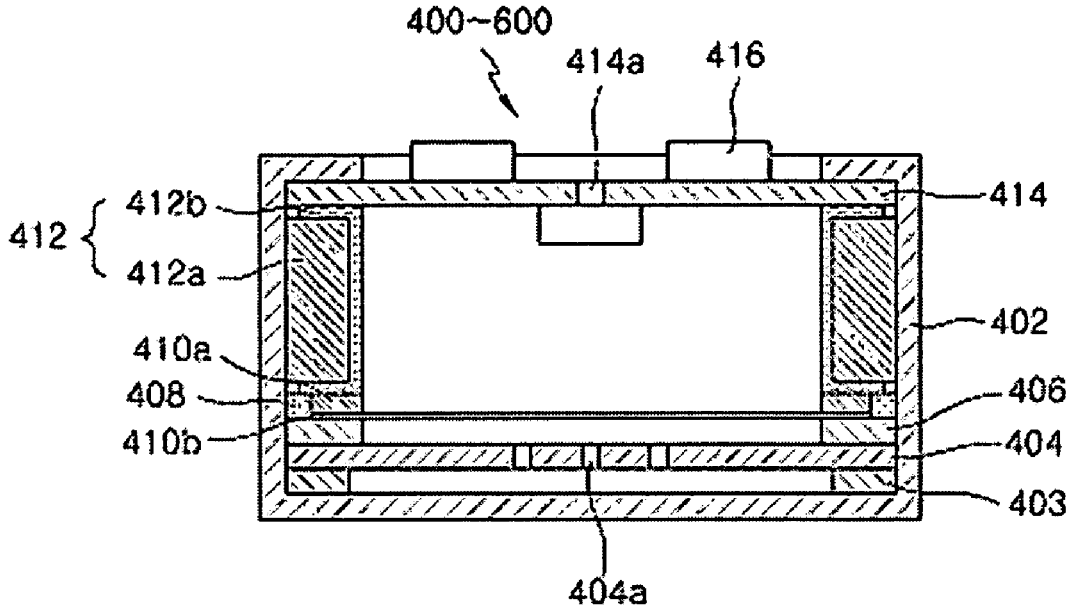
FIG. 10 is a sectional view of an assembled parallelepiped condenser microphone according to the fourth to sixth embodiments of the present invention.

FIG. 10 is a sectional view of an assembled parallelepiped condenser microphone according to the fourth to sixth embodiments of the present invention, in which reference numerals of the fourth embodiment are only presented for clarity.

Referring to FIG. 10, a condenser microphone (400-600) includes a metal ring 403, a backplate 404 with sound holes 404*a*, a spacer 406, a shield ring 408, a polar ring 410*a*, a membrane 410*b*, an integrated base ring 412 (a nonconductive ring and a conductive layer 412*b*), and a PCB 414 with a sound hole 414*a*, which are sequentially disposed in a rectangular case 402. After the disposing, a top end of the case 402 is curled.

Terminals 416 of the PCB 414 are protruded from the curled surface of the case 402, such that surface mounting process can be easily carried out to mount the condenser microphone (400-600) on a main PCB such as a main PCB of a cellular phone. The terminals 416 may be a Vdd terminal, a ground terminal and so on.

In the fourth to sixth embodiments, corners or edges of rectangular elements of the condenser microphone can be rounded for manufacturing or assembling convenience. An IC of the PCB may be a JFET, an amplifier, or an analog-to-digital converter. Also, the IC of the PCB may be an ASIC with a JFET, an amplifier, and an analog-to-digital converter.

The operation of the condenser microphone of fourth to sixth embodiments will now be described.

Vdd and GND powers are applied to the terminals 416 through terminals of a main PCB. Therefore, The membrane 410*b* is electrically connected with the PCB 414 through the conductive layer 412*b* and polar ring 410*a*, and the backplate 404 is electrically connected with the PCB 414 through the case 402.

Outside sound enters inside of the condenser microphone through the sound hole 414*a* of the PCB 414 and then reaches the membrane 410*b*. Also, outside sound enters inside of the condenser microphone through the sound hole 404*a* and then reaches the membrane 410*b*.

The membrane 410*b* vibrates in response to the sound pressure, changing the distance between the membrane 410*b* and the backplate 404. This distance change causes the capacitance of the membrane 410*b* and the backplate 404 to vary, such that an electrical signal proportional to the sound pressure can be produced. The electrical signal is transmitted to the IC of the PCB where the signal is amplified and outputted through the terminals 416.

As described above, the parallelepiped condenser microphone of the present invention is designed such that mounting direction of the condenser microphone can be easily detected during surface mounting process of the condenser microphone. Therefore, terminals of a main PCB and the terminals of the condenser microphone can be exactly connected to one another without polarity mismatch and abnormal alignment.

It will be apparent to those skilled in the art that various modifications and variations can be made in the present invention. Thus, it is intended that the present invention covers the modifications and variations of this invention provided they come within the scope of the appended claims and their equivalents. For example, the surface mount parallelepiped condenser microphone elements may be interchangeable and combined with corresponding elements of a different shaped elements (i.e. mixed together), e.g., as a square-shaped back plate may be employed with ring-shaped spacer, etc.

What is claimed is:

1. A surface mount parallelepiped condenser microphone, comprising:

a case having a rectangular box shape with an opening;

a metal ring insertable into the case;

a backplate having a circular shape with a sound hole;

a spacer having a thin ring shape;

an insulation ring having a hollow cylindrical shape with top and bottom openings;

a diaphragm facing the backplate with disposing the spacer therebetween when inserted in the insulation ring;

a conductive ring; and a printed circuit board (PCB) having a rectangular shape with a sound hole at a center portion, the PCB having one side on which a component is mounted and the other side from which a terminal is protruded, the PCB being electrically connected with the diaphragm through the conductive ring when assembled, wherein the metal ring, the backplate, the spacer, the insulation ring, the diaphragm, the conductive ring, and the PCB are sequentially disposed in the case, and the case is curled at the opening.

2. The surface mount parallelepiped condenser microphone of claim 1, wherein edges or corners of rectangular elements of the condenser microphone are rounded.

3. The surface mount parallelepiped condenser microphone of claim 1, wherein elements of the condenser microphone are interchangeable with corresponding elements of a different shape.

4. A surface mount parallelepiped condenser microphone, comprising:

a case having a rectangular box shape with an opening;

a metal ring having a rectangular shape with a circular opening at a center portion, the metal ring being insertable in the case;

a backplate having a rectangular shape with a sound hole;

a spacer having a rectangular shape with a circular opening at a center portion;

an insulation ring having a hollow rectangular prism shape with top and bottom openings;

a diaphragm having a rectangular shape with a circular membrane at a center portion, the diaphragm being insertable in the insulation ring;

a conductive ring having a rectangular shape with a circular opening at a center portion; and a PCB having a rectangular shape with a sound hole at a center portion, the PCB having one side on which a component is mounted and the other side from which a terminal is protruded, the PCB being electrically connected with the diaphragm through the conductive ring when assembled, wherein the metal ring, the backplate, the spacer, the insulation ring, the diaphragm, the conductive ring, and the PCB are sequentially disposed in the case, and the case is curled at the opening.

5. The surface mount parallelepiped condenser microphone of claim 4, wherein edges or corners of rectangular elements of the condenser microphone are rounded.

6. The surface mount parallelepiped condenser microphone of claim 4, wherein elements of the condenser microphone are interchangeable with corresponding elements of a different shape.

7. A surface mount parallelepiped condenser microphone, comprising:

a case having a rectangular box shape with an opening;

a metal ring having a rectangular shape with a rectangular opening at a center portion, the metal ring being insertable in the case;

a backplate having a rectangular shape with a sound hole;

a spacer having a rectangular shape with a rectangular opening at a center portion;

an insulation ring having a hollow rectangular prism shape with top and bottom openings;

a diaphragm having a rectangular shape with a rectangular membrane at a center portion, the diaphragm being insertable in the insulation ring;

a conductive ring having a rectangular shape with a rectangular opening at a center portion; and a PCB having a rectangular shape with a sound hole at a center portion, the PCB having one side on which a component is mounted and the other side from which a terminal is protruded, the PCB being electrically connected with the diaphragm through the conductive ring when assembled, wherein the metal ring, the backplate, the spacer, the insulation ring, the diaphragm, the conductive ring, and the PCB are sequentially disposed in the case, and the case is curled at the opening.

8. The surface mount parallelepiped condenser microphone of claim 7, wherein edges or corners of rectangular elements of the condenser microphone are rounded.

9. The surface mount parallelepiped condenser microphone of claim 7, wherein elements of the condenser microphone are interchangeable with corresponding elements of a different shape.

10. A surface mount parallelepiped condenser microphone, comprising:

a case having a rectangular box shape with an opening;

a metal ring insertable into the case;

a backplate having a circular shape with a sound hole;

a spacer having thin ring shape;

a nonconductive shield ring;

a diaphragm having a circular shape and being inserted in the shield ring;

an integrated base ring including a nonconductive ring and a metal-plated conductive layer formed on a predetermined surface of the nonconductive ring, the nonconductive ring having a hollow cylindrical shape with opened top and bottom; and a PCB having a rectangular shape with a sound hole at a center portion, the PCB having one side on which a component is mounted and the other side from which a terminal is protruded, the PCB being electrically connected with the diaphragm through the conductive layer of the integrated base when assembled, wherein the metal ring, the backplate, the spacer, the shield ring, the diaphragm, the integrated base ring, and the PCB are sequentially disposed in the case, and the case is curled at the opening.

11. The surface mount parallelepiped condenser microphone of claim 10, wherein the metal-plated conductive layer includes patterns formed on top and bottom ends of the nonconductive ring, and the nonconductive ring includes a through hole or a via hole to electrically connect the patterns each other.

12. The surface mount parallelepiped condenser microphone of claim 10, wherein edges or corners of rectangular elements of the condenser microphone are rounded.

13. The surface mount parallelepiped condenser microphone of claim 10, wherein elements of the condenser microphone are interchangeable with corresponding elements of a different shape.

14. A surface mount parallelepiped condenser microphone, comprising:

a case having a rectangular box shape with an opening;

a metal ring having a rectangular shape with a rectangular opening at a center portion, the metal ring being insertable into the case;

a backplate having a rectangular shape with a sound hole;

a spacer having a rectangular shape with a rectangular opening at a center portion;

a nonconductive shield ring having a rectangular shape with a rectangular opening at a center portion;

a diaphragm having a rectangular shape with a rectangular membrane at a center portion, the diaphragm being inserted in the nonconductive shied ring when assembled;

an integrated base ring including a nonconductive ring and a metal-plated conductive layer formed on a predetermined surface of the nonconductive ring, the nonconductive ring having a hollow rectangular prism shape with opened top and bottom; and a PCB having a rectangular shape with a sound hole at a center portion, the PCB having one side on which a component is mounted and the other side from which a terminal is protruded, the PCB being electrically connected with the diaphragm through the conductive layer of the integrated base when assembled, wherein the metal ring, the backplate, the spacer, the shield ring, the diaphragm, the integrated base ring, and the PCB are sequentially disposed in the case, and the case is curled at the opening.

15. The surface mount parallelepiped condenser microphone of claim 14, wherein the metal-plated conductive layer includes patterns formed on top and bottom ends of the nonconductive ring, and the nonconductive ring includes a through hole or a via hole to electrically connect the patterns each other.

16. The surface mount parallelepiped condenser microphone of claim 14, wherein edges or corners of rectangular elements of the condenser microphone are rounded.

17. The surface mount parallelepiped condenser microphone of claim 14, wherein elements of the condenser microphone are interchangeable with corresponding elements of a different shape.

18. A surface mount parallelepiped condenser microphone, comprising:

a case having a rectangular box shape with an opening;

a metal ring having a rectangular shape with a circular opening at a center portion, the metal ring being insertable into the case;

a backplate having a circular shape with a sound hole;

a spacer having a rectangular shape with a circular opening at a center portion;

a nonconductive shield ring having a rectangular shape with a rectangular opening at a center portion;

a diaphragm having a rectangular shape with a circular membrane at a center portion, the diaphragm being inserted in the nonconductive shied ring when assembled;

an integrated base ring including a nonconductive ring and a metal-plated conductive layer formed on a predetermined surface of the nonconductive ring, the nonconductive ring having a rectangular prism shape with opened top and bottom; and a PCB having a rectangular shape with a sound hole at a center portion, the PCB having one side on which a component is mounted and the other side from which a terminal is protruded, the PCB being electrically connected with the diaphragm through the conductive layer of the integrated base when assembled, wherein the metal ring, the backplate, the spacer, the shield ring, the diaphragm, the integrated base ring, and the PCB are sequentially disposed in the case, and the case is curled at the opening.

19. The surface mount parallelepiped condenser microphone of claim 18, wherein the metal-plated conductive layer includes patterns formed on top and bottom ends of the nonconductive ring, and the nonconductive ring includes a through hole or a via hole to electrically connect the patterns each other.

20. The surface mount parallelepiped condenser microphone of claim 18, wherein edges or corners of rectangular elements of the condenser microphone are rounded.

21. The surface mount parallelepiped condenser microphone of claim 18, wherein elements of the condenser microphone are interchangeable with corresponding elements of a different shape.

* * * * *